US009270054B2

(12) United States Patent
Beltzer

(10) Patent No.: US 9,270,054 B2
(45) Date of Patent: Feb. 23, 2016

(54) PLUG CONNECTOR

(75) Inventor: Patrick Beltzer, Jettingen (FR)

(73) Assignee: Multi-Holding AG, Allschwil (CH)

( * ) Notice: Subject to any disclaimer, the term of this patent is extended or adjusted under 35 U.S.C. 154(b) by 0 days.

(21) Appl. No.: 14/344,546

(22) PCT Filed: Sep. 6, 2012

(86) PCT No.: PCT/EP2012/067437
§ 371 (c)(1),
(2), (4) Date: Apr. 4, 2014

(87) PCT Pub. No.: WO2013/037699

PCT Pub. Date: Mar. 21, 2013

(65) Prior Publication Data

US 2015/0171554 A1 Jun. 18, 2015

(30) Foreign Application Priority Data

Sep. 13, 2011 (EP) ..... 11181039

(51) Int. Cl.
*H01R 13/10* (2006.01)
*H01R 13/64* (2006.01)
(Continued)

(52) U.S. Cl.
CPC ..... *H01R 13/64* (2013.01); *H01R 13/04* (2013.01); *H01R 13/10* (2013.01); *H01R 13/629* (2013.01); *H01R 13/6456* (2013.01); *H01R 2107/00* (2013.01)

(58) Field of Classification Search
CPC ... H01R 12/724; H01R 13/514; H01R 13/502
See application file for complete search history.

(56) References Cited

U.S. PATENT DOCUMENTS 4,193,655 A 3/1980 Herrmann, Jr.
5,466,171 A * 11/1995 Bixler ..... H01R 13/64 439/378

(Continued)

OTHER PUBLICATIONS

Translation of the International Preliminary Report on Patentability dated Mar. 27, 2014, issued by the International Searching Authority in corresponding International Application No. PCT/EP2012/067437.

(Continued)

*Primary Examiner* — Truc Nguyen
(74) *Attorney, Agent, or Firm* — Sughrue Mion, PLLC

(57) ABSTRACT

The invention relates to a releasable multi-plug connector comprising a socket side (1) with an insulating socket housing (10) and with a plurality of socket elements (2) which are received in the socket housing (10) and which comprise a socket portion (20) and a contact portion (21) for connecting to an external element in an electrically conductive manner, in particular a multipolar cable. The plug connector also comprises a plug side (3) with an insulating plug housing (30) and with a plurality of plug elements (4) which are received in the plug housing (30) and which comprise a pin portion (40) and a contact portion (41) for connecting to an external element in an electrically conductive manner, in particular a multipolar cable. The socket housing (10) and the plug housing (30) can be connected together along a plug direction (S), said pin portions (40) of the plug elements (4) protruding into the socket portions (20) of the socket elements (2) in the plugged state such that an electric contact can be provided between the socket side (1) and the plug side (2) via the socket portion (20) and the pin portion (40). The socket housing (10) and the plug housing (30) have a contact surface (11, 31) via which the socket housing (10) and the plug housing (30) are in contact. A wall (32) extends from the contact surface (31) of the plug housing (30) or the socket housing (10), said wall at least partly surrounding the pin portions (40) or the socket portions (20), and an opening (12) extends from the contact surface (11) that does not have the wall (32) into the socket housing (10) or the plug housing (30), the socket portions (20) or the pin portions (40) lying in said opening (12). The wall (32) cross-section perpendicular to the plug direction matches the opening (12) cross-section perpendicular to the plug direction, and the wall (32) protrudes into the opening (12) in the plugged state.

13 Claims, 6 Drawing Sheets

(51) Int. Cl.

| | |
|---|---|
| ***H01R 13/629*** | (2006.01) |
| ***H01R 13/645*** | (2006.01) |
| ***H01R 13/04*** | (2006.01) |
| *H01R 107/00* | (2006.01) |

(56) References Cited

U.S. PATENT DOCUMENTS

| | | | | |
|---|---|---|---|---|
| 5,667,393 | A * | 9/1997 | Grabbe | H01R 4/028 439/660 |
| 6,354,870 | B1 * | 3/2002 | Timmerman | H01R 23/6873 439/569 |
| 6,364,718 | B1 * | 4/2002 | Polgar et al. | 439/680 |
| 6,437,664 | B1 * | 8/2002 | Meppelink | H01G 4/35 333/182 |
| 6,646,858 | B2 * | 11/2003 | Dingenotto | H01R 13/7197 361/302 |
| 6,790,067 | B2 * | 9/2004 | Douty | H01R 23/27 439/284 |
| 6,860,765 | B1 * | 3/2005 | Spink, Jr. | H01R 23/7073 439/680 |
| 6,957,985 | B1 * | 10/2005 | Wang | H01R 13/6456 439/677 |
| 2006/0110978 | A1 | 5/2006 | Fan et al. | |
| 2006/0246780 | A1 | 11/2006 | Bert et al. | |
| 2007/0141908 | A1 * | 6/2007 | Bert et al. | 439/608 |

OTHER PUBLICATIONS

International Search Report of PCT/EP2012/067437, dated Oct. 4, 2012.

* cited by examiner

PLUG CONNECTOR

CROSS REFERENCE TO RELATED APPLICATIONS

This is a National Stage of International Application No. PCT/EP2012/067437 filed Sep. 6, 2012, claiming priority based on European Patent Application No. 11 181 039.6 filed Sep. 13, 2011, the contents of all of which are incorporated herein by reference in their entirety.

TECHNICAL FIELD

The present invention relates to a multiple-contact plug connector in accordance with the preamble of claim 1.

PRIOR ART

Multiple-contact or multi-pole plug connectors that comprise a multiplicity of connections that are arranged parallel to one another are known from the prior art. A multiplicity of electrical connections, in particular electrical connections that have different polarities, can be provided using a single plugging-together process.

By way of example, US 2006/0110978 illustrates a plug connector of this type, wherein the individual modules can be mutually connected by way of a dovetail joint.

One system of the applicant is also known by the product name CT-E8-2, wherein two poles can be installed in a contact carrier.

Experience has shown that problems can occur with an increasing number of poles during the plugging-together process. In particular, reference is made to the issue of canting that in part renders the production of the plug connector between the socket side and the plug side difficult if not impossible. The issue of canting can also lead to the electrically conductive elements of the socket side and/or the plug side becoming damaged and therefore rendering a successful plugging-together process impossible.

DESCRIPTION OF THE INVENTION

Based on this prior art, an object of the invention is to provide a multiple-contact or rather multi-pole plug connector that overcomes the disadvantages of the prior art. In particular the plug connector is to be produced in a simpler manner and its reliability is to be improved.

A multiple-contact plug connector according to claim 1 achieves an object of this type. Accordingly, a releasable multiple-contact plug connector comprises a socket side having an electrically insulating socket housing and having a plurality of socket elements that are received in the socket housing and comprise a socket section and a contact section for the purpose of providing an electrically conductive connection to an external element, in particular to a multi-wire cable, and said releasable multiple-contact plug connector comprises a plug side having an electrically insulating plug housing and having a plurality of plug elements that are received in the plug housing and comprise a pin section and a contact section for the purpose of providing an electrically conductive connection to an external element, in particular to a multi-wire cable. The socket housing can be plugged together with the plug housing along a plugging-together direction, wherein in the plugged-together state, the pin sections of the plug elements protrude into the socket sections of the socket elements so that an electrical contact arrangement can be provided between the socket side and the plug side by way of the socket section and the pin section. In each case, a pairing of a plug element and a socket element forms a pole. The socket housing and the plug housing each comprise a contact surface, by way of which in the plugged-together state, the socket housing and the plug housing are in contact with one another. A wall extends from the contact surface of the plug housing or of the socket housing and encompasses at least in part the pin sections or the socket sections that likewise extend out of the corresponding housing beyond the contact surfaces. An opening extends into the socket housing or the plug housing respectively from the contact surface that does not comprise the wall and the socket sections or the pin sections respectively lie in said opening, wherein the cross section of the wall in the direction perpendicular to the plugging-together direction matches the cross section of the opening in the direction perpendicular to the plugging-together direction and the wall protrudes into the opening in the plugged-together state.

The socket elements and accordingly the plug elements that lie in the region of the wall are protected against mechanical influences by virtue of the arrangement of the wall and the opening, so that the socket elements and accordingly the plug elements cannot bend and as a result it is possible to plug said socket elements and said plug elements together. As a consequence, the reliability is improved.

It is preferred that the wall protrudes entirely into the opening, which provides a compact connection between the socket side and the plug side.

In a preferred embodiment, the wall extends from the contact surface of the plug housing and the opening extends from the contact surface of the socket housing into the socket housing. As a consequence, the wall encompasses parts of the plug elements and the socket elements are arranged in the opening. This is a particularly simple configuration.

The plug elements and accordingly the socket elements when viewed from the contact surface are preferably embodied so as to be shorter than the wall so that the plug elements or accordingly the socket elements do not protrude beyond the wall. It is preferred that the plug elements and accordingly the socket elements when viewed from the base of the opening are embodied so as to be shorter than the depth of the opening from the contact surface to the base, so that the plug elements or the socket elements respectively are arranged entirely in the opening. As a consequence, it is ensured that during the plugging-together process, the socket side is aligned towards the plug side by means of pairing the wall and the opening prior to parts that are responsible for the electrical contact coming into contact with one another, which further increases the reliability.

The wall preferably comprises a multiplicity of grooves that are arranged in a direction parallel to the pin sections and accordingly the socket sections, wherein the grooves provide a depression and a ridge that extends from the depression. The grooves preferably encompass at least in part a socket element or respectively a plug element that extends parallel to the direction of the groove. It can also be said that the socket elements or the plug elements respectively are arranged at least in part in the groove.

It is preferred that at least one of the side walls that delimit the opening for the purpose of receiving the wall preferably also comprises a multiplicity of grooves that extend in the direction parallel to the pin sections and accordingly the socket sections, wherein the grooves provide a depression and a ridge that extends from the depression. The grooves preferably encompass at least in part a socket element or respectively a plug element that extends parallel to the direction of the groove.

The grooves are embodied in a rounded concave manner, and encompass in each case parts of the contact elements or of the socket elements respectively in a manner that is semi-circular in shape when viewed in the cross section, wherein in each case a socket element or a plug element respectively is preferably arranged in each groove.

It is preferred that, in the plugged-together state, in each case a groove in the wall and a correspondingly arranged groove in the side wall of the opening provide a duct between the socket side and the plug side and said duct is delimited by means of the ridges and entirely encompasses parts of socket elements and parts of plug elements, in particular the socket sections and the pin sections.

The electrical contact arrangement between the socket element and the plug element is preferably provided when viewed in relation to the plugging-together direction in the region of the opening and accordingly the wall and accordingly in the duct, in particular in a region that lies centrally in the opening and accordingly in the wall.

It is preferred that the wall is provided with apertures and that the opening is provided with reinforcing ribs, wherein, in the plugged-together state, the connecting ribs protrude into the apertures.

A polarizing element is preferably arranged in each case on the socket housing and on the plug housing, wherein the polarizing element is preferably arranged on at least one of the side walls that delimit the opening, and in each case a polarizing element is arranged at a position on the wall that corresponds to the side wall. Alternatively, the mentioned apertures and the reinforcing ribs provide a polarizing element.

The socket elements or the plug elements respectively are arranged in a receiving opening, said receiving opening being allocated to the respective socket element or plug element, wherein the socket elements or the plug elements respectively comprise a mounting section that is arranged between the contact section and the socket section or between the contact section and the pin section.

Further embodiments are disclosed in the dependent claims.

SHORT DESCRIPTION OF THE DRAWINGS

Preferred embodiments of the invention are hereinunder described with reference to the drawings that are used merely for the purpose of describing the invention and are not to be interpreted as restrictive. In the drawings.

DESCRIPTION OF PREFERRED EMBODIMENTS

Figure 1:
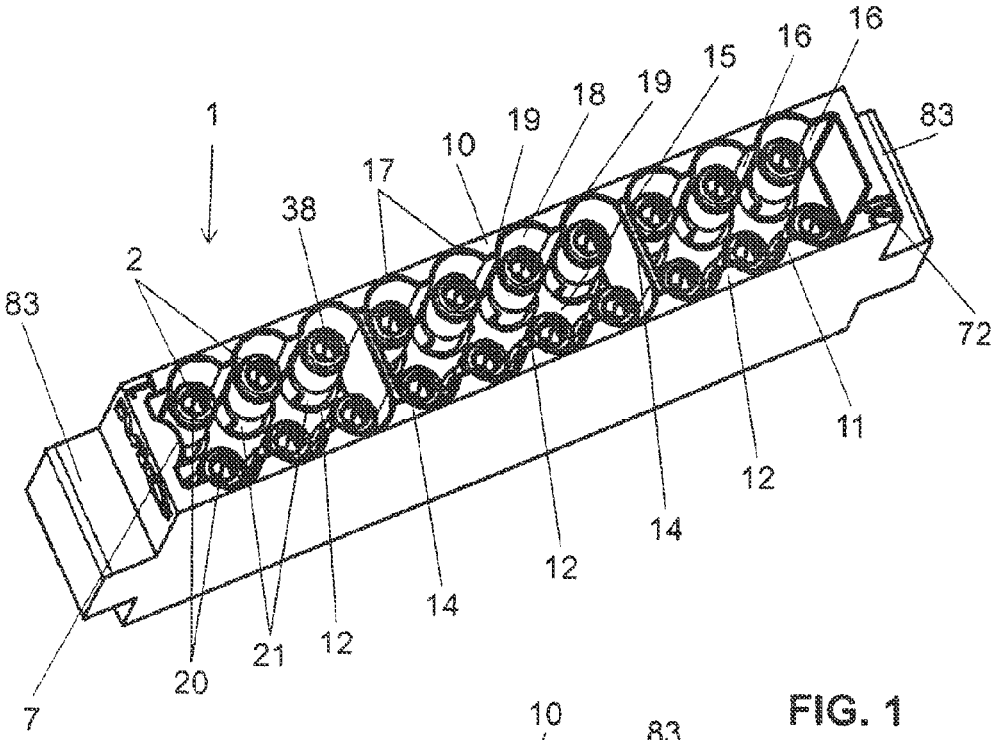
FIG. 1 illustrates a perspective view of a socket element for a plug connector in accordance with an embodiment of the present invention.
Figure 2:
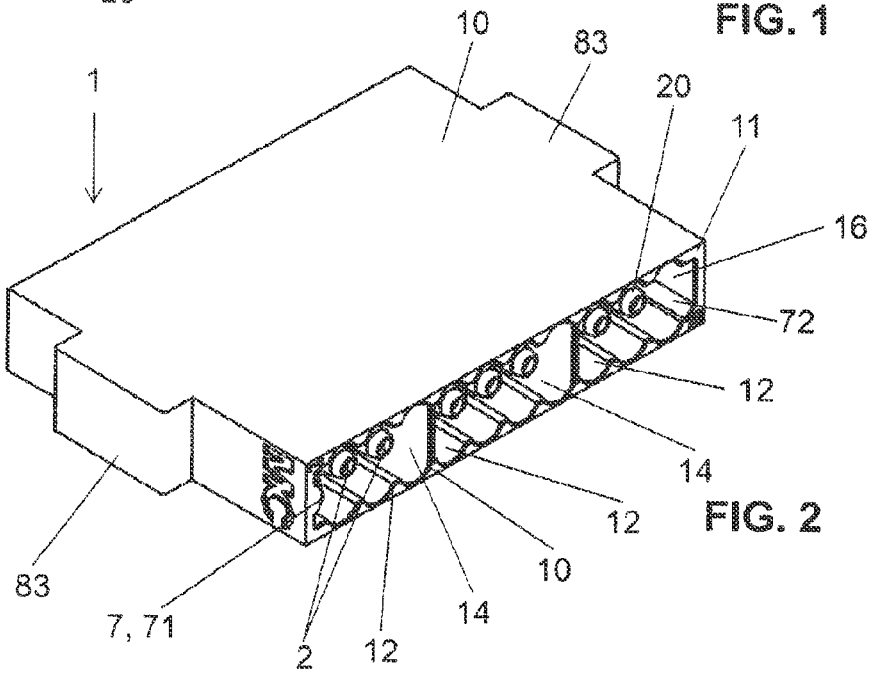
FIG. 2 illustrates a further perspective view according to FIG. 1.
Figure 3:
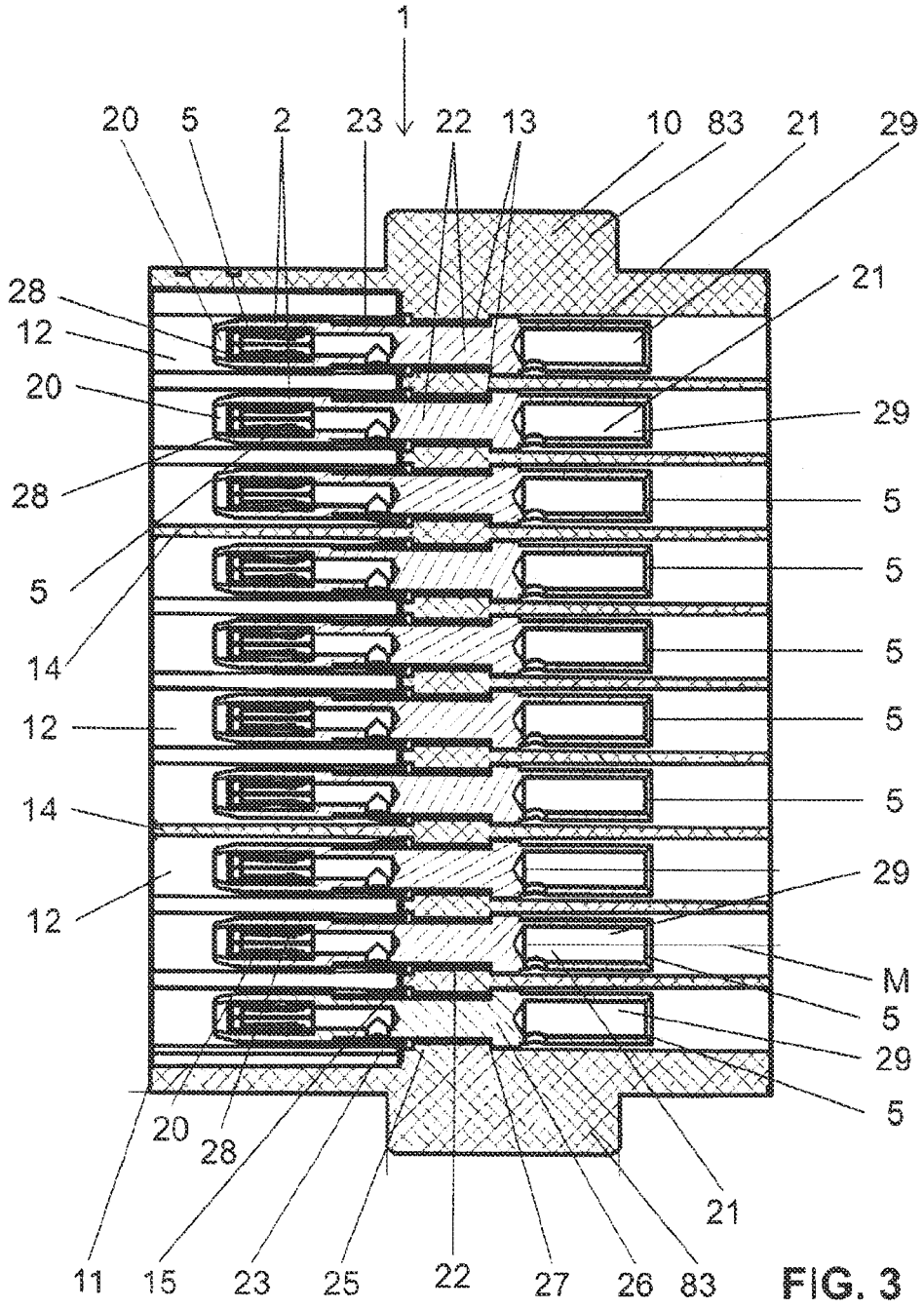
FIG. 3 illustrates a sectional view of the socket element according to FIGS. 1 and 2.
Figure 4:
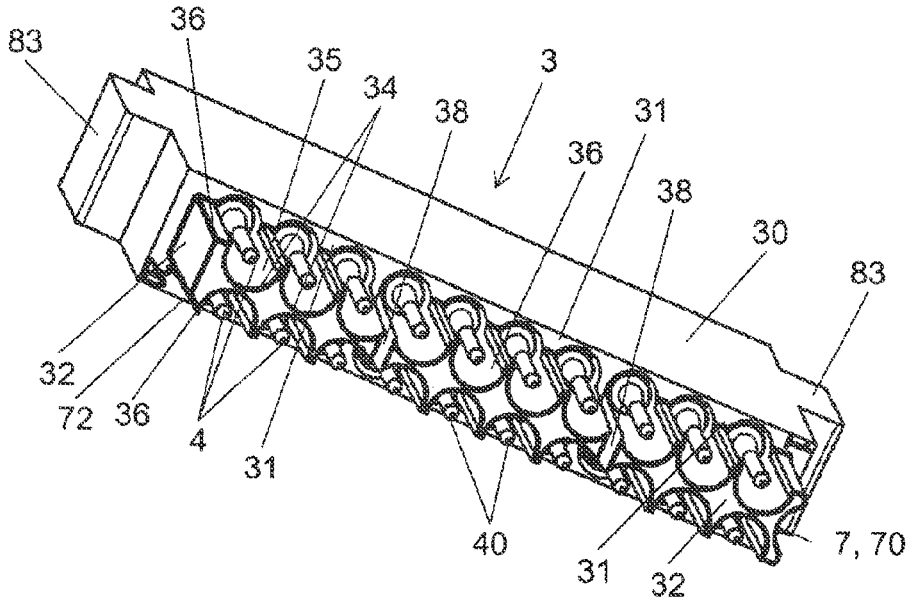
FIG. 4 illustrates a perspective view of a plug element for a plug connector in accordance with an embodiment of the present connection.
Figure 5:
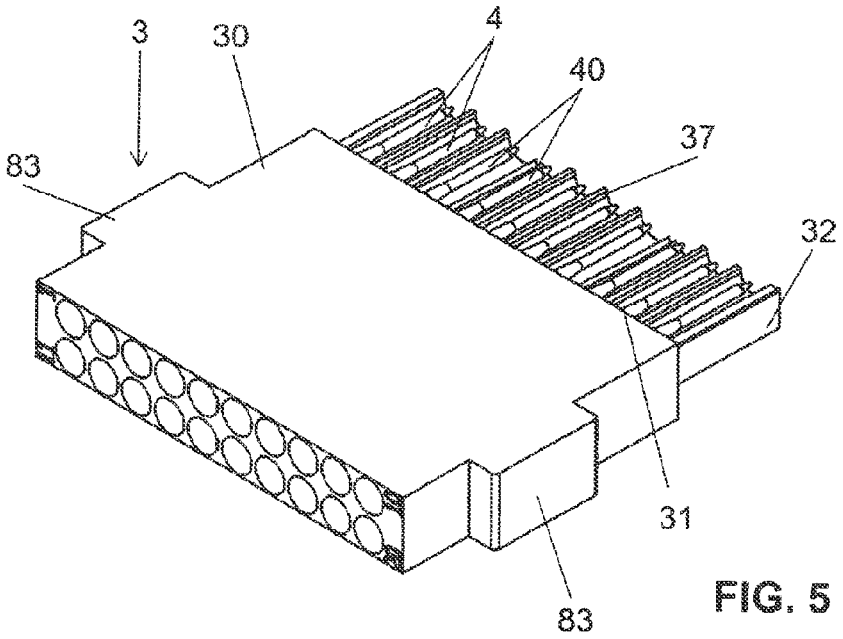
FIG. 5 illustrates a further perspective view according to FIG. 4.
Figure 6:
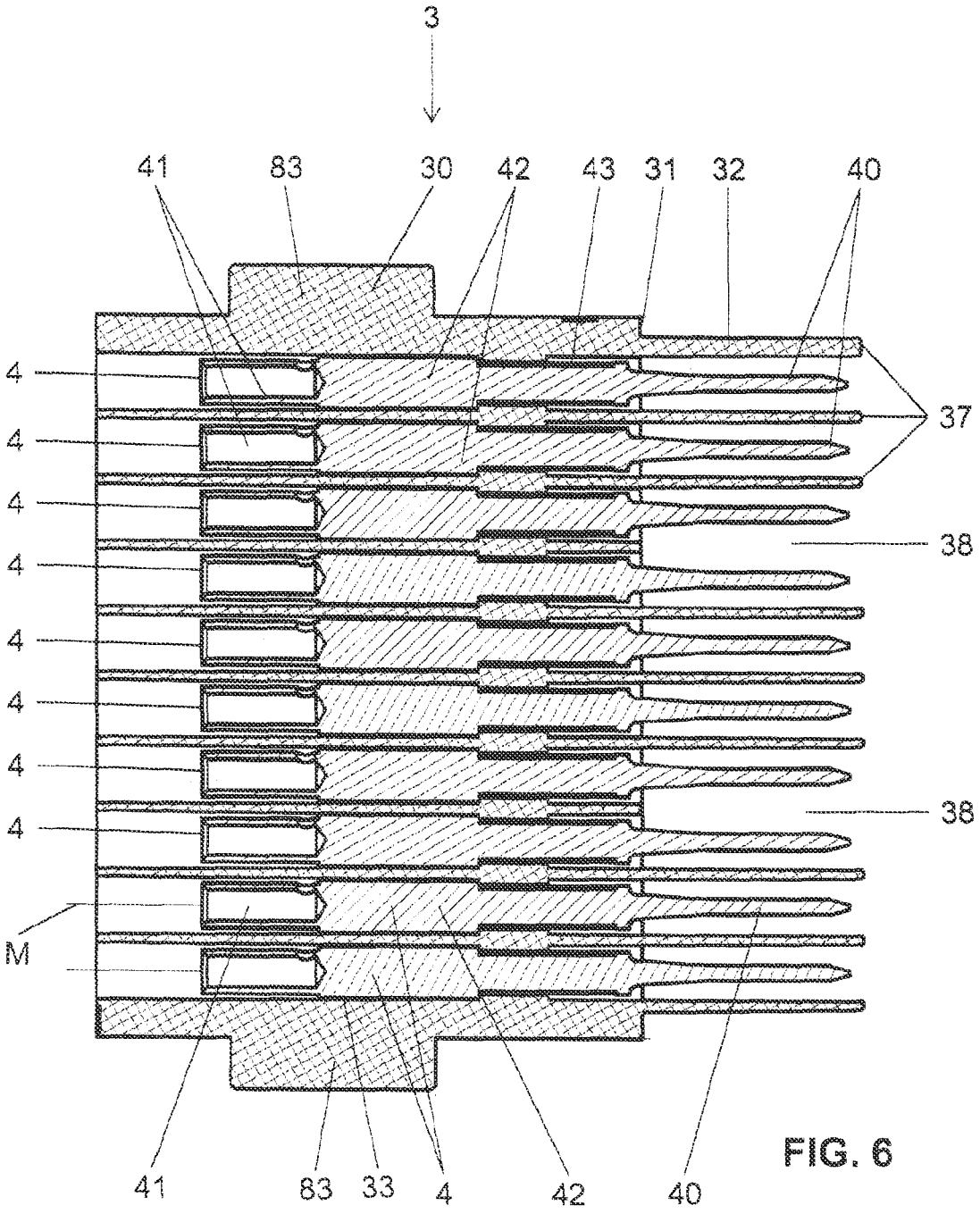
FIG. 6 illustrates a sectional view of the plug element according to FIGS. 4 and 5.

A socket side 1 of a releasable multiple-contact plug connector is illustrated in FIGS. 1 to 3 and the plug side 3 of said releasable multiple-contact plug connector is illustrated in FIGS. 4 to 6. The socket side 1 can be connected to and/or plugged together with the plug side 3 so that an electrically conductive contact arrangement can be provided between the socket side 1 and the plug side 3. The term "multiple-contact plug connector" is understood to refer to a plug connector by way of which several poles, in particular poles that have different potentials, can be connected simultaneously. The socket side 1 and the plug side 3 are in electrically conductive contact with an electrically conductive external element. The electrically conductive external element is in particular a multi-wire cable or several individual cables. As a consequence, several poles can be correspondingly connected using an individual plug connection and/or plug movement.

The socket side 1 comprises an electrically insulating socket housing 10, preferably embodied from synthetic material, having a plurality of socket elements 2 that are received in the socket housing 10. Each of the socket elements 2 represents a corresponding pole. The socket elements 2 comprise a socket section 20 and a contact section 21. The contact section 21 is in electrically conductive contact with the above mentioned external element and the socket section 20 is used for the purpose of receiving electrically conductive parts from the plug side 3.

The plug side 3 comprises an electrically insulated plug housing 30, preferably embodied from synthetic material, and a plurality of plug elements 4 that are received in the plug housing 30. The plug elements 4 represent a corresponding pole in the multi-pole connection. The plug elements 4 comprise a pin section 40 and a contact section 41. The contact section 41 is used for the purpose of providing an electrically conductive connection to an external element, in particular to a multi-wire cable. The pin section 40 forms the above mentioned electrically conductive part and protrudes into the socket section 20, wherein the electrical contact between the socket side 1 and the plug side 3 is then provided by way of the socket section 20 and the pin section 40.

Figure 7:
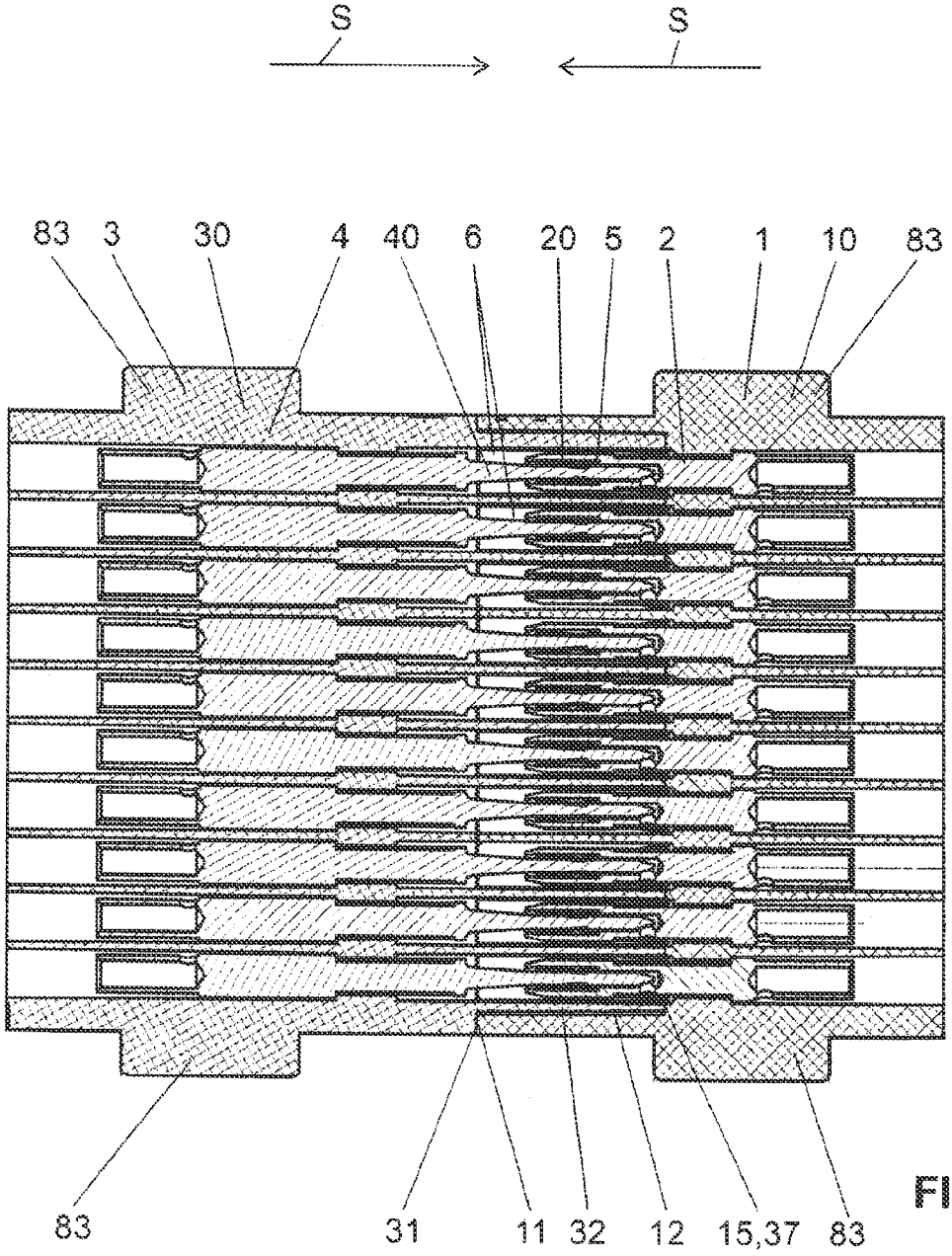
FIG. 7 illustrates a sectional view of the plug connector having a socket element according to FIGS. 1 to 3 and a plug element according to FIGS. 4 to 6.

The socket housing 10 and the plug housing 30 are embodied in such a manner that they can be plugged together. The plugging-together movement occurs along a plugging-together direction S, as is illustrated in FIG. 7. The plugging-together direction extends parallel to socket sections 20 and the pin sections 40 or rather parallel to the respective center axis M of the socket section 20 and the pin section 40. In the plugged-together state, the pin sections 40 of the plug elements 4 protrude into the socket sections 20 of the socket elements 2 and an electrical contact is thus provided between the socket side 1 and the plug side 3. The socket side 10 is described with reference to the FIGS. 1 to 3. The socket housing 10 comprises a contact surface 11 that is in contact with a corresponding contact surface 31 of the plug housing 30 and/or lies on said contact surface if the socket housing and the plug housing are plugged together. At least one opening 12 extends into the socket housing 10 from the contact surface 11. Three openings 12 are arranged next to one another. A multiplicity of apertures 13 extend through the socket housing 10 from the base 15 of the opening 12, as is clearly evident in FIG. 3. The apertures 13 can also be described as receiving openings 13, because they are used for the purpose of receiving the socket elements 4. The number of the receiving openings 13 corresponds to the number of poles. In this case, 20 poles are arranged distributed over two rows. Other embodiments in relation to the number of poles and the number of rows are also feasible.

The design of the socket element 2 is also clearly evident in FIG. 3. The socket element 2 comprises, as is already described above, a socket section 20 and a contact section 21. The socket element 2 is essentially embodied about its center axis M in a rotationally symmetrical manner and extends along the center axis M. The socket section 20 comes to lie in the opening 12 in the socket housing 10 and the contact section 21 comes to lie in the receiving opening 13. An electrical contact is provided in the receiving opening 13 between the external element and the socket element 2, such as by way of example a cable that is not illustrated here. The socket element 2 is mounted in the plug housing by way of a mounting section 22 that lies between the socket section 20 and the contact section 21. The mounting section 22 is simultaneously provided with a securing element 23 that secures the socket element 2 in the socket housing 10 in relation to axial movements. The securing element 23 can be embodied in numerous ways, in this case, the securing element 23 comprises the form of a spring that encompasses the mounting section 22 and lies against the protrusion 25 between the opening 12 and the receiving opening 13. The securing element 23 further comprises a flange 26 in the region of the contact section 21, this flange lies against a protrusion 27 in the receiving opening 13.

The socket element 2 comprises a socket opening 28 in the socket section 20, said socket opening extending along the center axis M of the socket element 2. This socket opening 28 is used for the purpose of receiving a pin section 40 of the plug element 4. It is preferred that an electrically conductive contact element 5 is arranged in the socket opening 28 and provides an electrical contacting arrangement between the socket element 2 and the plug element 4. The contact element 5 preferably comprises the form of a contact lamella, wherein the contact lamella comprises a multiplicity of resilient connecting pieces. These connecting pieces are then pressed against the wall of the socket opening 28 by means of the pin section 40 during the plugging-together process and thus provide an electrical contact arrangement between the socket opening 28 and the pin section 40.

The socket element 2 further comprises in this case an opening 29 in the region of the contact section 21. The cable of a multi-pole conductor can be fed into this opening 29 and can be mechanically or materially connected at this site to the socket element 2 in an electrically conductive manner.

As is explained above, the opening 12 of the socket housing 10 is clearly evident in FIGS. 1 and 2. The opening 12 is provided in this case with two reinforcing ribs 14 that provide three small openings 12 from a large opening 12. A different distribution of openings or also the arrangement of only a single opening 12 is likewise feasible. The socket elements 2 are arranged in the opening 12 and said socket elements comprise a length that is shorter than the depth of the opening 12 from the contact surface 10 to the base 15 of the opening 12. As a consequence, it is ensured that the socket elements 2 do not protrude beyond the contact surface 10 and accordingly do not protrude out of the opening 12, which is advantageous in relation to mechanical loads in the separated state. Mechanical loads, such as by way of example blows to the socket side 1, are absorbed by means of the socket housing 10 before an impact occurs on the socket element 2. As a consequence, the socket sections 20 are arranged in the socket housing 10 in such a manner that they are correspondingly protected.

The structure of the plug side 3 is explained with the aid of the FIGS. 4 to 6. Similar to the socket side 1, the plug side 3 also comprises on the plug housing 30 a contact surface 31 by way of which the socket housing 10 and the plug housing 30 are in contact and/or lie against one another if the socket side 1 is located in the plugged-together state with the plug side 3.

The plug housing is further explained with reference to FIGS. 4 and 5 in which it is evident that a wall 32 extends from the contact surface 31. This wall 32 is used to protect the parts of the plug element 4 that extend beyond the contact surface 31, in this case essentially the pin section 40. The wall 32 is embodied in such a manner that said wall encompasses at least in part the pin sections 40 or rather extends between the pin sections 40. The wall 32 is embodied to match the opening 12 so that the socket side 1 can be connected to the plug side 3. In the connected state, the wall 32 protrudes into the opening 12. The cross section of the wall 32 when viewed in the direction perpendicular to the plugging-together direction S is embodied to match or compliment the cross section of the opening 12 likewise in the direction perpendicular to the plugging-together direction S. As a consequence, the wall 32 therefore protrudes into the opening 12 in the plugged-together state.

In an alternative embodiment, the opening 12 and the wall 32 are arranged in such a manner that the wall 32 is also formed on the socket element 2, wherein the opening 12 is then arranged on the plug element 4. In relation to FIGS. 1 and 4, it can then be said that the socket elements 2 that are arranged in the socket housing 10 can also be arranged in the plug housing 30, wherein the plug elements 4 are correspondingly arranged in the socket housing 10. As a consequence, the socket elements 2 would then correspondingly protrude beyond the contact surface on the plug housing 30 and the plug elements 4 would then be arranged in the opening 12 and be protected by means of the side wall 16 against the mechanical influences, said side wall encompassing the opening 12. The wall 32 then correspondingly protects the socket elements 2 against mechanical influences.

As a consequence, it can also be said that the wall 32 can extend both from the contact surface 11 of the socket housing 10 and from the contact surface 31 of the plug housing 30 and that the opening 12 is then arranged on the other housing without the wall.

The wall 32 and the opening 12 therefore have the advantage that these two elements protect the socket elements 2 and the plug elements 4 in relation to mechanical influences. During the plugging-together process, it is important that the center axes M of the socket elements 2 extend collinearly to the center axes M of the plug element 4. The wall 32 and the opening 12 have a guiding function during the plugging-together process so that the socket side 1 and the plug side 3 can be plugged together in a parallel as possible manner along the direction of the plugging-together movement, whereby the issue of canting between the socket side 1 and the plug side 3 is avoided to a large extent.

Reference is made to FIG. 6 in relation to the plug elements 4. The plug element 4 is embodied essentially in a rotationally symmetrical manner about a center axis M and extends along this center axis M. The plug element 4 comprises a pin section 40 that protrudes into the socket opening 28 of the socket section 20 and is in electrical contact with the socket element by way of the contact element 5. Furthermore, the plug element 4 comprises a contact section 41 that provides the electrically conductive connection to an external element, in particular to a multi-wire cable. The plug element 4 further comprises a mounting section 42 that is arranged in this case between the contact section 41 and the pin section 40. The plug element 4 is mounted in a receiving opening 33 in the plug housing 30 by way of the mounting section 42. Similar to the socket element 2, the plug element 4 also comprises a securing element 43 that secures the plug element 4 in the receiving opening with respect to axial displacements along its center axis M. The securing element 43 can be embodied in a similar manner to the securing element 23. Reference is made in this respect to the above description.

It is also clearly evident in FIG. 6 that the parts of the plug element 4 that extend from the contact surface 31, in this case said parts being pin sections 40, when viewed from the contact surface 31 are embodied so as to be shorter than the wall 31 from the contact surface to the front end 37. As a consequence, the pin sections 40 do not protrude beyond the wall 31 which has the above described advantage in relation to the mechanical load.

In the connected state that is evident in FIG. 7, the wall 32 protrudes entirely into the opening 12. Furthermore, the contact surface 11 of the socket side 1 is in contact with the contact surface 31 of the plug side 3. It is preferred that the height of the wall 32 from the contact surface to the front end 37 of the wall 32 corresponds to the depth of the opening 12 from the contact surface 11 to the base 15 of the opening 12.

It is further evident in FIGS. 4 and 5 that the wall 32 preferably comprises a multiplicity of grooves 34 that extend in the direction parallel to the pin sections 40. The grooves 34 provide a depression 35 and a ridge 36 that extends from the depression 35. Typically, two ridges 36 that extend parallel to one another delimit a depression 35. The pin section 40 of the plug element 4 extends in the depression 35, wherein the pin section 40 lies at least in part in this depression 35.

It is further evident in FIG. 1 that the side walls 16 likewise comprise a multiplicity of grooves 17. The grooves 17 extend likewise in a direction parallel to the socket section 20 of the socket element 2. The grooves 17 provide a depression 18 in the side wall 16, wherein the depression 18 is correspondingly delimited by means of a ridge 19.

In the plugged-together state, in each case a groove 17 in the side wall 16 of the socket housing 10 and a groove 34 of the wall 32 of the plug housing 30 provide a duct 6 between the socket side 1 and the plug side 2, wherein this duct 6 is laterally delimited by means of the ridges 19 and 36. The duct 6 entirely encompasses the socket sections 20 and the pin sections 40 and, as a consequence, protects the connection between the socket section 20 and the pin section 40 against mechanical exterior influences. The duct 6 is particularly clearly evident in FIG. 7.

The grooves 17 and 34 are preferably embodied in a rounded concave manner when viewed in the cross section perpendicular to the plugging-together direction. The radius of the rounding of the grooves 17 in the opening 12 is advantageously identical to the radius of the rounding of the grooves 34 on the wall 32 and, as a consequence, the groove 17 and the groove 34 provide a duct 6 having an identical and/or constant diameter. A socket element 2 and a plug element 4 is preferably arranged in each case per duct 6.

The grooves 17 and 34 advantageously have an identical depth so that the surface of the corresponding ridge is located at the height of the center axis M of the socket element 2 or the plug element 4 respectively. The corresponding ridges therefore extend essentially to a plane that through all center axes M of the socket elements 2 and the plug elements 4 and accordingly of the receiving openings in which this socket element 2 and plug element 4 are arranged. As a consequence, each of the grooves provides in each case a half of the duct 6.

The wall 32 can be provided with apertures 38. In the plugged-together state, the reinforcing ribs 14 extend through these apertures. As a consequence, the guiding arrangement between the socket housing 10 and the plug housing 30 can be further improved during the plugging-together process.

An optional polarizing element 7 is arranged in each case on the socket housing 10 and on the plug housing 30. The polarizing element has the advantage that the parts cannot be plugged together incorrectly. The polarizing element 7 is preferably arranged on at least one of the side walls 16 that delimit the opening 12 and at a position on the wall 32 that corresponds to the side wall 16. In this case, the polarizing element comprises the form of a channel 70 that extends in the plugging-together direction S and is arranged in the wall, and a projection 71 that is embodied in a corresponding manner and extends from the side wall 16 into the opening 12. Alternatively, the mentioned apertures 38 and the reinforcing ribs 14 provide the function of a polarizing element. In addition, the wall 32 and/or opening 12 can also be provided with an inclined section 72 that can likewise provide a polarizing element.

The socket housing 10 and the plug housing 30 are preferably embodied from a material, such as a synthetic material, that does not conduct an electrical current.

Figure 8:
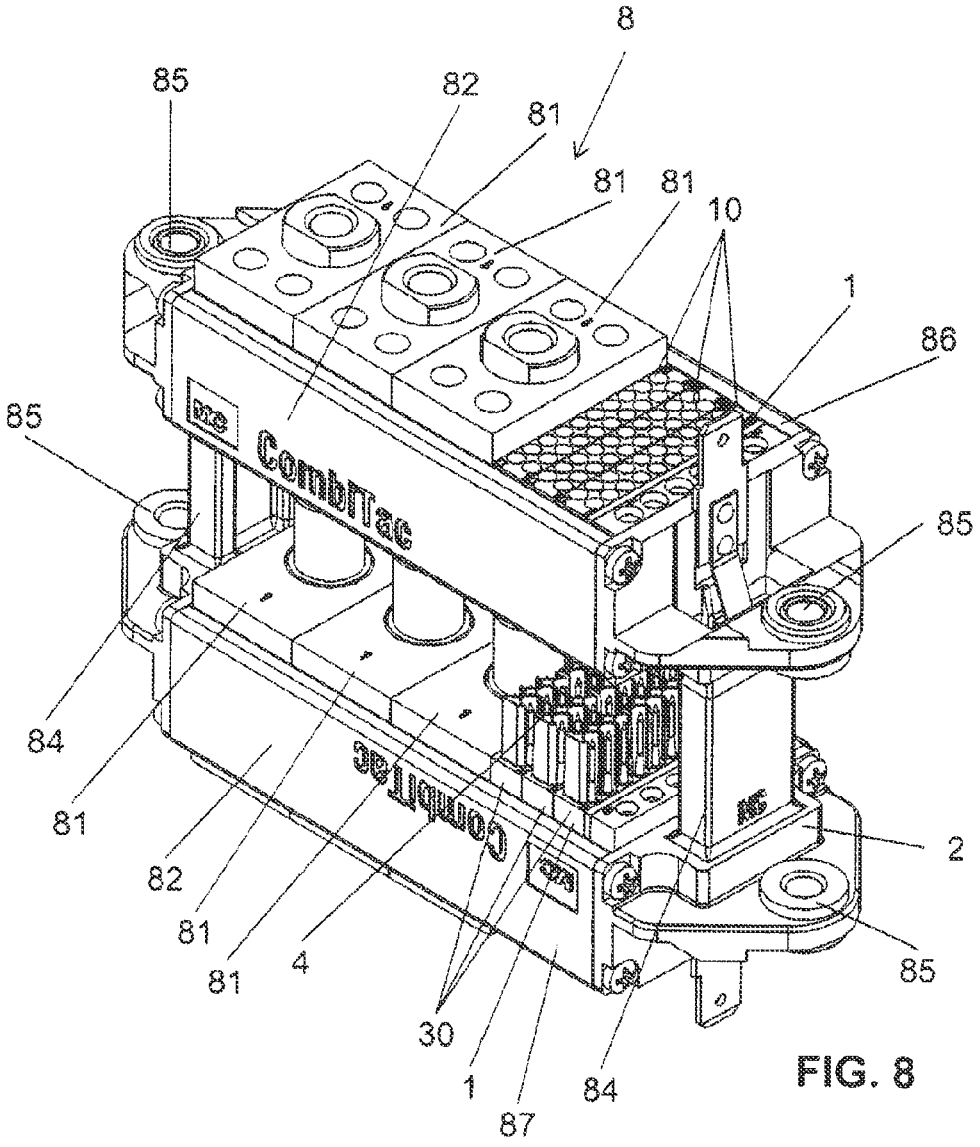
FIG. 8 illustrates an example for the possible application of a multi-pole plug connector according to the preceding figures.

A possible application of a multi-pole plug connector 1 in accordance with the above description is illustrated in FIG. 8. The plug connector 1 having the socket side 1 and the plug side 3 is arranged in this figure a plug connector 8 that is constructed in a modular manner. The plug connector 8 comprises a socket-side contact carrier 86 and a plug-side contact carrier 87. Three socket sides 1 and accordingly socket housings 10 are arranged in the socket-side contact carrier 86 in accordance with the above description and three plug sides 3 and accordingly plug housings 30 are arranged in the plug-side contact carrier 87. Furthermore, further plug elements 81 are arranged here and are likewise mounted by means of the contact carriers 86, 87.

The socket housing 10 and the plug housing 30 are in each case encompassed respectively by a frame element 82 that holds the socket housing 10 and accordingly the plug housing 10 together in a corresponding manner. The further plug elements 81 are also encompassed by means of the frame element 82. The socket housing 10 and plug housing 30 comprise for this purpose extensions 83 that engage in channels on the frame element 82.

A simple multi-pole connection can be provided by means of the arrangement of a plurality of socket sides 1 and plug sides 3 and accordingly socket housings 10 having socket elements 2 and plug housings 30 having plug elements 4 in a frame and said connection can be plugged together using a single plugging-together process.

The frame element 82 further comprises guiding aids 84 for the purpose of guiding the parts during the plugging-together process and fastening elements 85 for the purpose of securing the parts against releasing in the plugged-together state or for the purpose of fastening the frame elements to an external element, such as a plate or similar.

LIST OF REFERENCE NUMERALS

| | |
|---|---|
| 1 | Socket Side |
| 2 | Socket Element |
| 3 | Plug Side |
| 4 | Plug Elements |

-continued

| LIST OF REFERENCE NUMERALS | |
|---|---|
| 5 | Contact Element |
| 6 | Duct |
| 7 | Polarizing Element |
| 8 | Plug Connector |
| 10 | Socket Housing |
| 11 | Contact Surface |
| 12 | Opening |
| 13 | Apertures, Receiving Openings |
| 14 | Reinforcing ribs |
| 15 | Base |
| 16 | Side Wall |
| 17 | Grooves |
| 18 | Depression |
| 19 | Ridge |
| 20 | Socket Section |
| 21 | Contact Section |
| 22 | Mounting Section |
| 23 | Securing Element |
| 25 | Protrusion |
| 26 | Flange |
| 27 | Protrusion |
| 28 | Socket Opening |
| 29 | Connecting Opening |
| 30 | Plug Housing |
| 31 | Contact Surface |
| 32 | Wall |
| 33 | Receiving Opening |
| 34 | Grooves |
| 35 | Depression |
| 36 | Ridge |
| 37 | Front End |
| 38 | Apertures |
| 40 | Pin Sections |
| 41 | Contact Section |
| 42 | Mounting Section |
| 43 | Securing Element |
| 70 | Channel |
| 71 | Projection |
| 81 | Plug Elements |
| 82 | Frame Element |
| 83 | Extensions |
| 84 | Guiding Aids |
| 85 | Securing Elements |
| 86 | Socket-side Contact Carrier |
| 87 | Plug-side Contact Carrier |

The invention claimed is:

1. A releasable multiple-contact plug connector comprising:

a socket side with an insulating socket housing and with a plurality of socket elements that are received in the socket housing, said socket elements having a socket section and a contact section for the purpose of providing an electrically conductive connection to an external element, in particular to a multi-wire cable, and a plug side with an insulating plug housing and with a plurality of plug elements that are received in the plug housing, said plug elements having a pin section and a contact section for the purpose of providing an electrically conductive connection to an external element, in particular a multi-wire cable, wherein the socket housing can be plugged together with the plug housing along a plugging-together direction, and wherein in the plugged-together state, the pin sections of the plug elements protrude into the socket sections of the socket elements so that an electrical contact arrangement can be provided between the socket side and the plug side by way of the socket section and the pin section, and wherein the socket housing and the plug housing comprise a contact surface, by way of which the socket housing and the plug housing are in contact with one another, wherein a wall extends from the contact surface of the plug housing or of the socket housing, which wall encompasses at least in part the pin sections or the socket sections or rather extends between the pin sections or the socket sections, wherein an opening extends into the socket housing and the plug housing, respectively from the contact surface that does not comprise the wall, and the socket sections and the pin sections, respectively lie in said opening, wherein the cross section of the wall in the direction perpendicular to the plugging-together direction matches the cross section of the opening in the direction perpendicular to the plugging-together direction and in the plugged together state, the wall protrudes into the opening, wherein the wall comprises a multiplicity of grooves that extend in the direction parallel to the pin sections or the socket sections respectively, wherein the grooves provide a depression and a ridge that extends from the depression, and wherein the grooves encompass at least in part parts of the socket element or the plug element.

2. The releasable plug connector as claimed in claim 1, wherein the wall extends from the contact surface of the plug housing and wherein the opening extends from the contact surface of the socket housing into the socket housing.

3. The releasable plug connector as claimed in claim 1, wherein the plug elements and accordingly the socket elements when viewed from the contact surface are embodied so as to be shorter than the wall and/or wherein the plug elements and accordingly the socket elements when viewed from the base of the opening are embodied so as to be shorter than the depth of the opening from the contact surface to the base and consequently are arranged entirely in the opening.

4. The releasable plug connector as claimed in claim 1, wherein at least one of the side walls that delimit the opening for the purpose of receiving the wall comprises a multiplicity of grooves that extend in the direction parallel to the pin sections and accordingly the socket sections, wherein the grooves provide a depression and a ridge that extends from the depression, wherein the grooves encompass at least in part parts of the socket element or plug element.

5. The releasable plug connector as claimed in claim 4, wherein the grooves are embodied in a rounded concave manner and encompass in each case parts of the contact elements or of the socket elements respectively in a manner that is semi-circular in shape when viewed in the cross section, wherein in each case a socket element or a plug element respectively is preferably arranged per groove.

6. The releasable plug connector as claimed claim 4, wherein, in the plugged-together state, in each case a groove in the wall and a correspondingly arranged groove in the side wall of the opening provide a duct between the socket side and the plug side, and said duct is delimited by means of the ridges and entirely encompasses parts of the socket elements and parts of the plug elements in particular the socket sections and the pin sections.

7. The releasable plug connector as claimed in claim 1, wherein the electrical contact arrangement is provided between the socket element and the plug element when viewed in relation to the plugging-together direction in the region of the opening and accordingly the wall and accordingly in the duct, in particular in a region that lies centrally in the opening and/or the wall.

8. The releasable plug connector as claimed in claim 1, wherein the wall is provided with apertures, and wherein the opening is provided with reinforcing ribs, wherein in the plugged-together state, the reinforcing ribs protrude into the apertures.

9. The releasable plug connector as claimed in claim 1, wherein a polarizing element is arranged on the socket housing and on the plug housing, wherein the polarizing element is preferably arranged on at least one of the side walls that delimit the opening, and a polarizing element is arranged at a position on the wall, said position corresponding to this side wall, or wherein the mentioned apertures and the reinforcing ribs provide a polarizing element.

10. The releasable plug connector as claimed in claim 1, wherein the socket elements or the plug elements respectively are arranged in a receiving opening in the socket housing or in the plug housing respectively, said receiving opening being allocated to the respective socket element or the plug element, wherein the socket elements or the plug elements respectively comprise a mounting section that is arranged between the contact section and the socket section or between the contact section and the pin section.

11. The releasable plug connector as claimed in claim 1, wherein a multiplicity of socket elements or plug elements respectively are arranged in a row that extends perpendicularly to the plugging-together direction, wherein several rows are preferably arranged next to one another and wherein the wall(s) extend between these rows.

12. The releasable plug connector as claimed in claim 1, wherein the height of the wall from the contact surface to the front end of the wall corresponds essentially to the depth of the opening from the contact surface to the base of the opening.

13. The releasable plug connector as claimed in claim 1, wherein the socket section or the pin section is provided with a contact element, in particular a contact lamella, wherein the electrical contact arrangement can be provided between the socket element and the plug element by way of this contact element.

* * * * *